US005609035A

United States Patent [19]

Cothern et al.

[11] Patent Number: 5,609,035

[45] Date of Patent: Mar. 11, 1997

[54] METHOD AND APPARATUS FOR FREEZING LARGE BLOCKS OF A LIQUID OR SLURRY

[75] Inventors: Billy Cothern, Alpharetta; Joseph A. Ramsey, Lawrenceville; Clifford L. Stapler, Fayetteville, all of Ga.

[73] Assignee: Uni-Temp Refrigeration, Inc., Norcross, Ga.

[21] Appl. No.: 466,571

[22] Filed: Jun. 6, 1995

Related U.S. Application Data

[62] Division of Ser. No. 334,207, Nov. 4, 1994, Pat. No. 5,535,598.

[51] Int. Cl.[6] ..... F25C 5/08

[52] U.S. Cl. ..... 62/73; 62/356

[58] Field of Search ..... 62/66, 73, 356, 62/352; 249/79

[56] References Cited

U.S. PATENT DOCUMENTS

| | | | |
|---|---|---|---|
| Re. 34,210 | 4/1993 | Lane et al. . | |
| 948,131 | 2/1910 | Bull | 249/79 |
| 1,322,660 | 11/1919 | Voorhees | 62/356 X |
| 2,942,430 | 6/1960 | Rising et al. | 62/73 X |
| 3,074,246 | 1/1963 | Wilbushewich | 62/352 X |
| 3,678,696 | 7/1972 | Cheng et al. . | |
| 3,713,304 | 1/1973 | Knutrud . | |
| 4,045,979 | 9/1977 | Mazzini | 62/352 |
| 4,207,750 | 6/1980 | Simkens | 62/352 X |
| 4,596,120 | 6/1986 | Knodel et al. . | |
| 4,694,656 | 9/1987 | Lane et al. . | |
| 4,840,033 | 6/1989 | Garland . | |
| 4,992,669 | 2/1991 | Parmley . | |

*Primary Examiner*—William E. Tapolcai
*Attorney, Agent, or Firm*—Morris, Manning & Martin, L.L.P.

[57] ABSTRACT

A system and method for freezing large quantities of a liquid or slurry are disclosed. The system includes a product containment apparatus for containing the liquid to be frozen, a freeze station for freezing the liquid, and a lift for raising the product containment apparatus to the freeze station for freezing. Freezing members extending from the freeze station include a pair of plate carriers mounted in a V configuration mounted within a V shaped casing. The shape of the casing and sloping walls of the product containment apparatus facilitate the removal of the ice block from the freeze station and the product containment apparatus from the frozen block, respectively. Preferably, the freezing members are provided with a baffle mounted at the open ends of the plate carriers to facilitate the sweeping of lubricating oil entrained in a refrigerant into a suction path within the freezing member so it may be removed. Alternative embodiments and processes are disclosed.

9 Claims, 3 Drawing Sheets

METHOD AND APPARATUS FOR FREEZING LARGE BLOCKS OF A LIQUID OR SLURRY

This is a division of application Ser. No. 08/334,207, filed Nov. 4, 1994, now U.S. Pat. No. 5,535,598.

FIELD OF THE INVENTION

This invention relates to block freezers, and more particularly, to devices for freezing large blocks of a liquid or slurry for warehouse storage and shipment.

BACKGROUND OF THE INVENTION

Systems for freezing water and other liquids in large quantities are well known. Many of these systems are used in building environmental systems such as water chillers and the like. These devices are used to take advantage of energy savings which are typically available in low energy demand hours such as early morning. These devices typically include refrigeration coils through which a saturated refrigerant liquid is pumped to cool the coil. The pump and compressor used to provide this liquid through the coil are typically operated with electrical energy. During low demand times, the compressor and pump are operated at lower electrical energy costs to cool the coil. Water is trickled through the coils and as it cools, it freezes on the coils and ice builds outwardly from the coils.

During the day when cool air is needed to maintain the temperature within a building at a comfortable level, air is circulated through the coils prior to being pumped through a building. As long as the coil remains encased in the ice, the compressor and pump need not be operated or are operated less frequently to supply refrigerant and cool the coils. The ice provides a heat exchanger surface which removes heat from the air prior to its circulation through the building. As this air cooling system continues to operate, the amount of heat absorbed by the ice begins to melt the ice about the coils. The water drips into a collection tank below the coils where it is stored. Later, during the low demand hours, the coils are supplied with refrigerant to cool them and the water is pumped from the collection reservoir to the top of the system so that it may trickle about the coils for freezing. Thus, the ice is used to reduce energy costs for cooling a building by time shifting the demand for electrical energy required to cool the building.

Large commercial ice freezers are also known. These devices typically use hollow members which are operated in much the same ways as the refrigerating coils of the building cooling systems described above. These hollow devices are typically arranged in a horizontal or vertical fashion and controls are provided for the controlled flow of refrigerant through the members. Water is provided at a constant rate on the outside surfaces of the hollow members so that it cools and freezes as it traverses along the surface area of the member. The ice is permitted to build to a preferred predetermined thickness at which time, the refrigerant liquid is no longer supplied to the hollow members. Instead, a defrosting gas is supplied to the member to warm the outer walls of the freezing member. Thus, as these walls warm, they melt the ice nearest the wall of the member causing the ice to fall. If the freezing members are arranged in a horizontal fashion, a surface to catch the falling ice may be located proximate the freezing member so the ice may be removed and then uniformly cut for bagging and the like. When the coils are arranged in a vertical manner, the ice typically falls off the freezing member and breaks into pieces which are then collected and bagged for commercial distribution.

Within the fruit juice industry, juice processors are confronted with the problem of providing juice to the market as it is needed throughout the year. This problem stems from the fact that there is typically only one harvest of fruit in a year. For example, the harvesting of oranges occurs at approximately a single time throughout the United States. As a consequence, the oranges are sent to fruit processors who extract the juice within weeks of the harvest. Thus, the fruit processors effectively have their entire supply for a market year in a relatively short time. Normally, the market is unable to purchase and consume the entire amount of juice processed at the harvest. As a result, fruit juice processors have sought ways to preserve the quality of the processed juice so they may supply the market steadily throughout the year.

In response to this need for preserving fruit juice, fruit processors or juice distributors initially built very large refrigerated warehouses for storing the juice. After the juice is processed, it is stored in 55 gallon drums sterilized for food and stacked within the refrigerated warehouses. These warehouses are maintained at temperatures at which the juice freezes within the drum. As the juice is needed, the barrels are removed from the refrigerated warehouse and permitted to thaw so the juice may be removed from the drums and appropriately packaged for market.

A number of problems arise from this type of storage of the processed juice. One problem arises from the time required for the juice to freeze. In many of these warehouses, the temperature is not uniformly maintained and the placement of numerous barrels within an area of the warehouse at one time requires an exchange of a great deal of heat from the juice before it freezes. As a result, not all of the barrels freeze at the same time and in some cases a period as long as three weeks is required before all the juice freezes. During that time period, some of the juice may begin to experience flavor degradation which may affect the taste of the juice within the drums.

Another problem with the large refrigerated warehouses is the efficiency of utilizing the storage space within the warehouses. Because the drums have a general cylindrical shape, they leave air spaces between adjacent drums as they are pushed together. As a result, a substantial amount of the space within the warehouse is not utilized to store juice.

Another problem with the warehouse storage method is the cost of the drums. To contain the amount of juice typically obtained by a processor or distributor, a significant number of barrels are needed. These barrels must be specially treated to hold the juice without contaminating the juice. Additionally, the transportation of the drums from the juice collection facility to the warehouse and the stacking operations at the warehouse damage the storage drums. The cost of buying the drums, treating the drums and replacing the damaged drums may be significant for the juice processor or distributor.

Attempts to use the chillers and block freezers previously known to freeze large amounts of juice or other liquids have not been successful for a number of reasons. For one, the coils of the previously known systems are not sufficiently sized to freeze the large amounts of juice that a typical processor would need to freeze. Another problem is the ice harvest method which requires the collection of the frozen liquid after it falls. Because the juice is not sold in plastic bags as is commercially available ice, the frozen juice fragments would have to be swept into some type of rigid container to provide sufficient structure so the juice may be stacked in the warehouse. Storage in conventional plastic bags used for ice is not feasible because the lower bags in the storage stack would probably break from the weight of the stack. As a result, the known chillers and freezers do not reduce the expense associated with drums and the like.

Another problem with existing chillers and freezers is the design of the coils. The coils are typically metal tubes that are smoothly bent to form a U-shaped structure. One is coupled to the high side of a refrigeration pump or compressor and the second end is coupled to the low pressure or return side of the cooling system. In the compressors typically associated with such systems, the refrigerant becomes entrained with lubricating oil. This entrainment occurs in the compressor as the oil which lubricates the movable member that compresses the refrigerant is squeezed through the gaskets and rings about the compression chamber. This oil greatly increases in viscosity in the coldest areas of the coil and tends to collect there, coating the interior heat exchange surface of the coil which reduces the freezing capacity and efficiency of the coil. The accumulation of the oil may be sufficient to block a coil because the temperatures needed to freeze the juice should be maintained for a relatively long time to freeze the large amounts of juice required by a juice processor.

What is needed is a system that freezes the amount of juice available at a fruit harvest without requiring large numbers of rigid containers such as metal drums and the like. What is needed is a method of freezing large amounts of liquid that can be efficiently stored. What is needed is a freezing structure that can freeze large amounts of liquid without accumulating lubricating oil sufficient to block the structure or significantly impede the freezing process. What is needed is a method of freezing large amounts of liquid in a relatively short period of time.

SUMMARY OF THE INVENTION

The above-identified problems are solved by a system built in accordance with the principles of the present invention. The system is comprised of a container for holding a liquid, a lift for vertically moving the container, a freezing station having freezing members extending therefrom, the freezing members having an inlet and outlet for refrigerant to cool a liquid and for defrosting gas to thaw a frozen liquid, a bagger for sealing the frozen liquid, and a conveyor for moving the container and the bagged frozen liquid.

The inventive system is operated in a method to block freeze a liquid for efficient storage and shipment. This method is comprised of the steps of moving a container filled with a liquid to a lift, raising the container with the lift so that freezing members extending from a freezing station extend into the liquid, supplying refrigerant to the freezing members so that the freezing members absorb heat from the liquid whereby the liquid freezes, supplying a defrosting media to the walls of the container whereby the frozen liquid adjacent the walls of the container is melted, lowering the container with the lift so that the container is separated from the frozen liquid, bagging the frozen liquid while it remains frozen to the freezing members, removing the container from the lift, raising the lift to support the bagged frozen liquid, supplying defrosting gas to the freezing members whereby the frozen liquid adjacent the freezing members is melted, lowering the lift so that the frozen block is removed from the freezing members, conveying the frozen block from the lift and sealing the bag about the frozen block.

The system built in accordance with the principles of the present invention and the method for using this system to block freeze a liquid overcomes the limitations of the previously known systems. By supplying refrigerant to the freezing members which are extended into the liquid, the freezing time for the liquid is reduced from hours or even weeks to minutes. Thus, the freshness and quality of the juice is preserved and more juice may be frozen in a more time efficient manner.

Additionally, the frozen liquid assumes the shape of the container used to hold the liquid while it is being frozen. If this shape is substantially rectilinear, the bag of frozen liquid may be stacked and placed adjacent to other bagged frozen liquids to substantially eliminate the air space between adjacent blocks. Thus, larger amounts of frozen juice may be stored within the same amount of space that were previously used to store the drums. As a consequence, fruit processors may reduce the size of the warehouses needed and the cost of maintaining the temperature within those warehouses is reduced because there is less air space to cool.

Another advantage of the inventive system is the elimination of the use of drums for juice storage because the system of the present invention does not require rigid drums or the like. Instead, the materials used to bag the frozen liquids are polymeric such as plastics and the like. These materials are relatively inexpensive compared to metal drums. Accordingly, the cost of freezing and storing the juice is substantially reduced.

The inventive system includes other elements to further facilitate the freezing of the liquids. In one aspect of the invention, the walls of the container are sloped outwardly to provide an inclined plane which facilitates the separation of the frozen block from the container. In a similar manner, the freezing members which extend into the liquid preferably have sloped walls so that the frozen block is more easily separated from the freezing members when the warming gas is circulated through the freezing members.

In a preferred embodiment, the freezing members are constructed by using rectangular plates to increase the surface area for heat transfer over more conventionally known tubular coils. This construction includes two hollow refrigerant plate carriers arranged in a V configuration so the lower ends of the plate are proximate one another while the upper ends are separated. At the bottom of each of the hollow plates, a curved baffle is provided and at the upper end of each hollow plate is an inlet. This V configuration of plates is placed within a V walled container having a solid outside wall so that the refrigerant does not escape into the liquid being frozen. An outlet is located in the casing so the outlet is in fluid communication with the space separating the carrier plates. An opening in the casing permits the inlet for the plates to extend through the casing. The inlet is coupled to a refrigerant/defrosting agent supply and the outlet is coupled to a suction source. The baffle at the lower end of the plates facilitates the sweeping of the oil entrained in the refrigerant into the space between the plates so it may be more easily removed by the suction source. Thus, the possibility of the freezing member becoming blocked by accumulated lubricating oil is substantially reduced.

Additional features and advantages of the present invention and method for block freezing a liquid may be appreciated from reading the detailed description and the drawings attached hereto.

BRIEF DESCRIPTION OF THE DRAWINGS

The present invention may take form in various components and arrangement of components and in various steps and arrangement of steps. The drawings are only for purposes of illustrating a preferred embodiment and are not to be construed as limiting the invention.

DETAILED DESCRIPTION OF THE INVENTION

Figure 1:
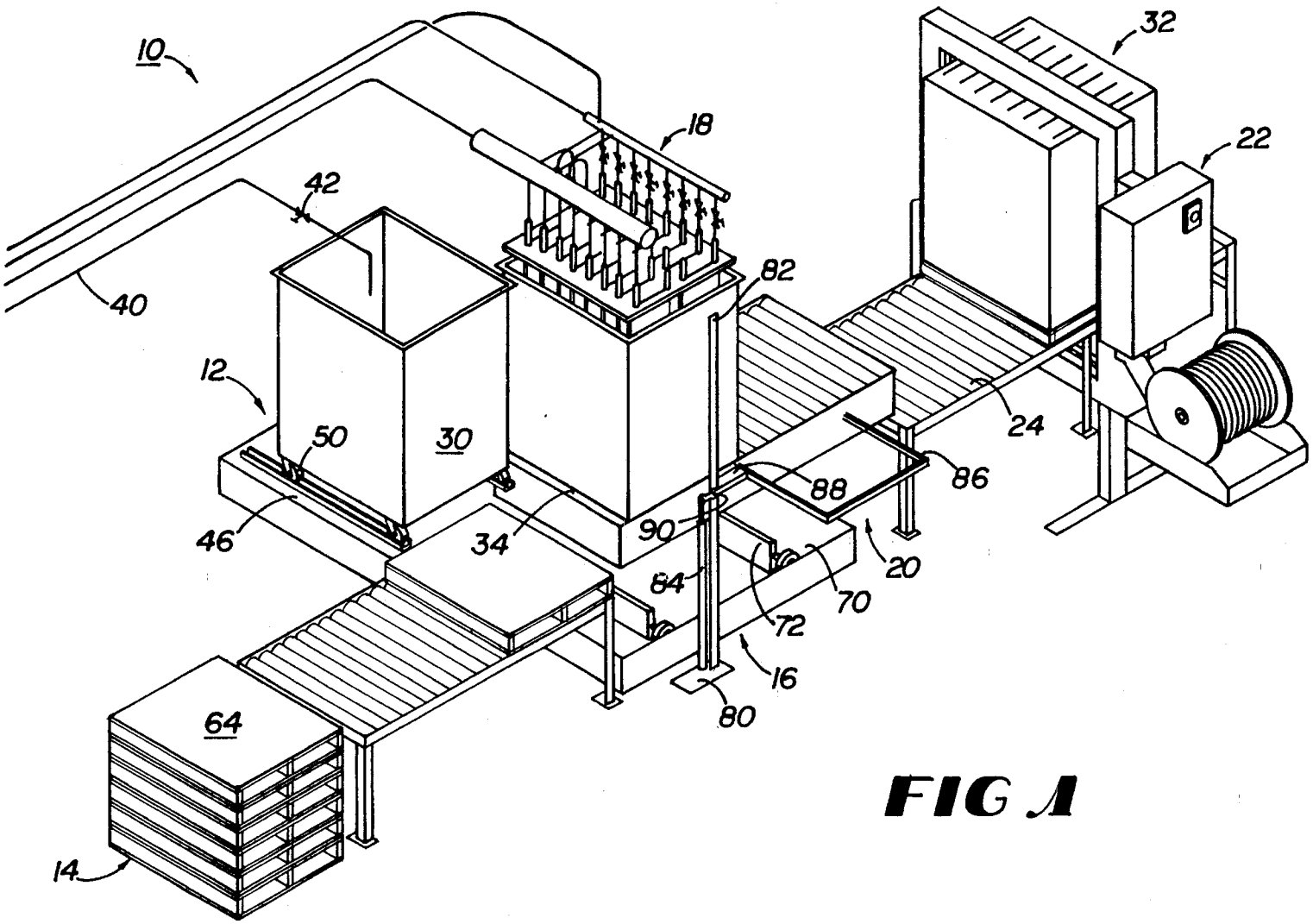
FIG. 1 is a perspective view of the components comprising a preferred embodiment of a system in accordance with the principles of the present invention.

A system 10 for block freezing a liquid or slurry built in accordance with the principles of the present invention is shown in FIG. 1. The system includes a fill station 12, a pallet supply station 14, a lift 16, a freeze station 18, a bagger 20, a sealer 22, and a conveyor 24. Briefly, the liquid or slurry to be frozen is supplied to the fill station and placed within a vessel or product containment apparatus (PCA 30). The PCA 30 is selectively moveable between the fill station 12 and the lift 16. A conveyor 24 extends from pallet supply 14 to lift 16 and from the lift 16 to an unloading area 32. Preferably, lift 16 has rollers or other type of moving surface mounted to its weight bearing surface 34 to provide a conveying path from the pallet supply 14 to the unloading area 32. Freeze station 18 is supplied with refrigerant for freezing the liquid within the PCA 30 and defrosting gas or liquid for removing the PCA 30 from the frozen block and releasing the frozen block from the freeze station 18. Bagger 20 places a polymeric bag about the frozen block of liquid so it may be sealed by sealer 22 prior to being conveyed to the unloading area 32.

In more detail, fill station 12 includes PCA 30, product supply conduit 40, and product supply control 42. Product supply control 42 may include a valve for controlling the flow of product through the product supply conduit 40 to the PCA 30. The supply control 42 may also include a manual mechanism such as a rotatable handle for manipulating the valve to control the flow of liquid, a liquid level sensor mounted within PCA 30 to detect the presence of the liquid at a predetermined height within PCA 30, or a weight sensing device which may be mounted on the surface 46 bearing the weight of PCA 30 to generate a signal when the PCA and the product contained therein reach a predetermined weight. Any such method may be used to prevent the over filling of PCA 30.

PCA 30 may be equipped with rollers or wheels 50 to facilitate its movement between fill station 12 and the lift 16. Other means of moving the PCA 30 between the fill station 12 and the lift 16 may also be used. For example, a track or movable belt device may be used or a bed of rollers such as those comprising conveyor 24 may also be used. Because PCA 30 is designed to contain a large amount of liquid, for example, 200 gallons, PCA 30 is preferably equipped with some locomotion means to facilitate its movement between fill station 12 and lift 16.

Figure 2:
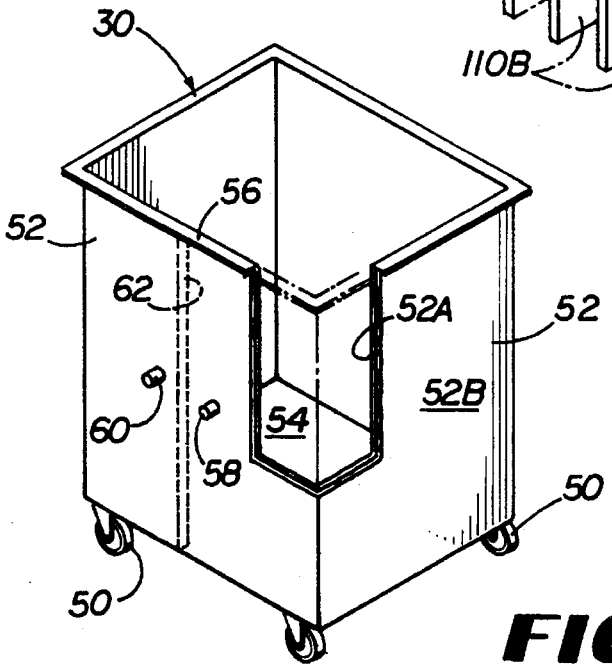
FIG. 2 is a perspective of a preferred embodiment of a product containment apparatus shown in the system of FIG. 1.

The structure of the product containment apparatus is shown in more detail in FIG. 2. As shown there, the product containment apparatus 30 includes four vertically standing walls 52 extending from a horizontal bottom plate 54. Preferably, a cleanout drain (not shown) is mounted in the bottom plate 54 of PCA 30. Preferably, the vertical standing walls 52 slope outwardly from the bottom plate 54 for reasons discussed in more detail below. Preferably, the walls slope at 2 to 5 degrees from the bottom plate. Walls 52 of the preferred embodiment of the PCA 30 are comprised of an inner and outer wall 52*a* and 52*b*. The walls and the flange 56 extending across the top of each of the vertical standing walls 52, along with bottom plate 54 comprise a volume which a refrigerant or defrosting media, such as a gas or liquid, may fill. Preferably, an inlet coupler 58 and outlet coupler 60 are mounted on walls 52 to be in fluid communication with the interior space of the walls 52. Preferably, PCA 30 is constructed with a divider 62 to ensure that the refrigerant or defrosting media traverses the space within the walls 52. Other known methods of directing fluid flow may be used such as channeling or the like. Inlet 58 is typically coupled to a pressurized refrigerant liquid or defrosting media source to fill the volume within each of the vertical standing walls 52 to assist in the freezing of the liquid within the PCA or the thawing of the frozen liquid to release the PCA from the frozen liquid within it. Outlet 60 is typically coupled to a suction source to return the refrigerant liquid or defrosting media to a compressor or pump.

As shown in FIG. 1, pallets are preferably used in the system 10 to support a block of frozen liquid after it has been bagged so the block may be moved to the unloading area 32. The pallets 64 are conventional and should be of a sufficient size to adequately support the frozen block of liquid and to adequately bear the weight of the liquid in its frozen state. The conveyor 24 may be a bed of free rolling cylindrical rollers as shown in FIG. 1, although other locomotion means may be used such as a mechanized belt mounted on rollers or the like.

Lift 16 of FIG. 1 includes a weight bearing surface 34, a support surface 70, and extendable members 72 mounted therebetween. Preferably, lift 16 is a scissors lift that is hydraulically operated to raise and lower the weight bearing platform 34. Preferably, weight bearing platform 34 includes a locomotion means that cooperates with conveyor 24 to provide a contiguous path for movement of the pallets, frozen blocks, and PCA 30 through system 10. In the preferred embodiment, the lift 16 is manufactured by Advance Lifts, Inc. of St. Charles, Ill. and designated by model Advance HD-1260.

Bagger 20 shown in FIG. 1 is comprised of a base 80, a support arm 82, a rectangular frame 86 and a retractable arm 84. The end 88 of retractable arm 84 is mounted to rectangular frame 86 by means of a swivel 90. Swivel 90 permits rectangular frame 86 to be selectively moved into and out of proximity to the frozen liquid at freeze station 18. Rectangular frame 86 is adapted to engage the open end of a polymeric bag. By locating rectangular frame 86 beneath the lower edge of a block of frozen liquid at freeze station 18 and then raising retractable arm 84 so that rectangular frame 86 is proximate the upper edge of the frozen block, the bag may cover the bottom and sides of the frozen block. Once the block of frozen liquid is released from the freeze station, the rectangular frame 86 may be further extended by retractable arm 84 to clear the top surface of the frozen block and release the top edge of the bag. Frame 86 may be swiveled out of the path of the freeze station 18.

Sealer 22 automatically folds the bag opening about the frozen block and seals the bag using straps, bands or some other known method such as heat sealing or the like. In the preferred embodiment, the strapping machine is manufactured by Signode, Inc. of Glenview, Ill. and designated by part number SP-710.

Figure 3:
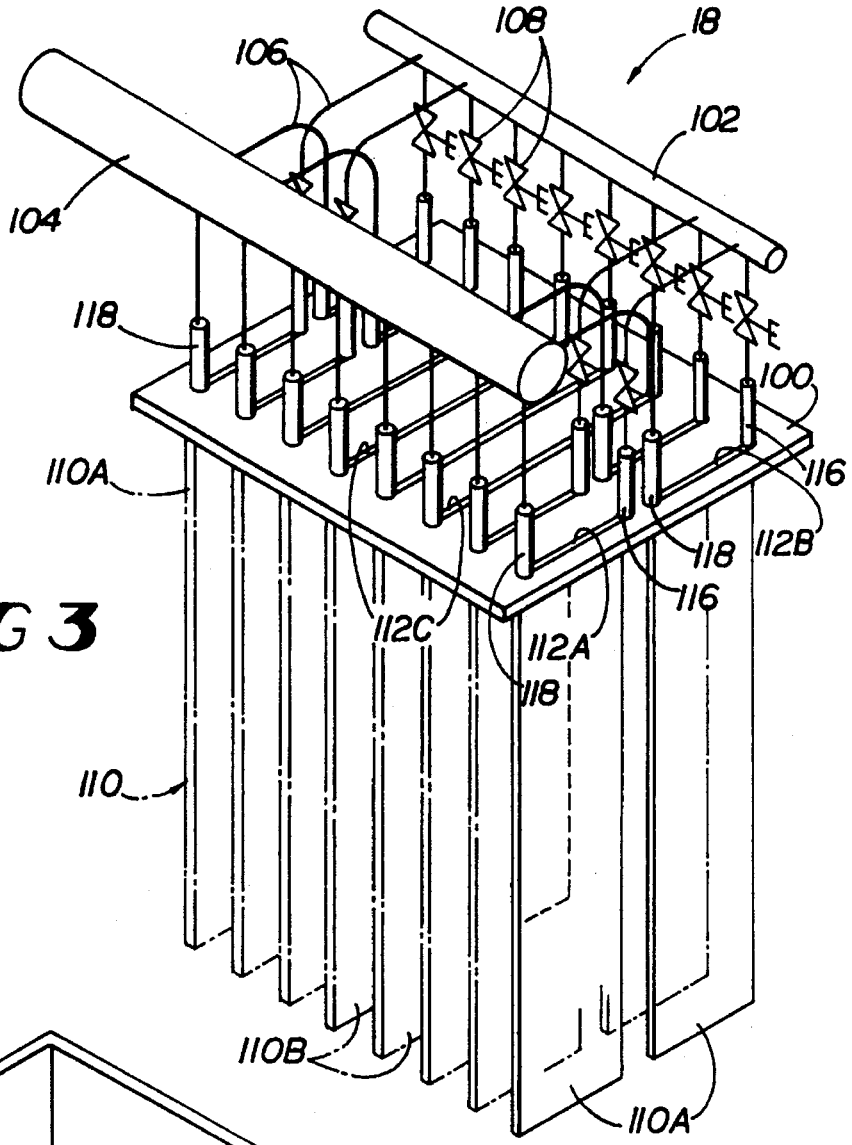
FIG. 3 is a perspective view of a preferred embodiment of a freeze station shown in FIG. 1.

The freeze station 18 is shown in more detail in FIG. 3. The freeze station 18 includes a mounting plate 100, refrigerant supply conduit 102, suction conduit 104, coupling lines 106, controllable valves 108, and freezing members 110. Mounting plate 100 is preferably provided with slots 112 for mounting freeze members 110 to the mounting plate, although other known mounting methods may be used. Inlets 116 and outlets 118 extend from the freezing members 110 through plate 100 for coupling to lines 106. As shown in FIG. 3, each freezing member 110 has an inlet 116 that is coupled through a coupling line 106 to refrigerant supply conduit 102. Although ammonia is the preferred refrigerant, other known refrigerants may be used, such as Freon or the like. A controllable valve 108 is preferably interposed between the refrigerant supply conduit 102 and the freezing member inlet 116 for each member 110 to control the rate of refrigerant into the freezing member 110. Each freezing member also has an outlet 118 associated therewith which extends from the freezing member through plate 100. A coupling line 106 couples suction conduit 104 to the outlet 118 of each of the freeze members 110. This arrangement provides a fluid flow path from the refrigerant supply conduit 102 through the coupling lines 106 and controllable valves 108 into the inlets 116 of the freezing members 110. After the refrigerant circulates through a freezing member 110, it is pulled through outlet 118 and coupling lines 106 into the suction conduit 104 for recycling through the refrigeration pump or compressor.

The freezing station shown in FIG. 3 has a mounting plate 100 which preferably has two linearly aligned slots 112*a*, 112*b* for the outer two rows at each end of the mounting plate 100. Mounted within each of these slots is a freezing member 110*a* having a width that is less than one-half of the full width freezing members 110*b* which preferably occupy the longer slots 112*c* cut in the interior section of the mounting plate 100. Use of the two narrower freezing members 110*a* rather than a single full width member 110*b* at the outer ends of mounting plate 100 provides additional strength and stability for the frozen block product produced by freezing station 18. Alternatively, double aligned slots may be used for each row in mounting plate 100 or each row may use a single slot. Preferably, the freezing members are rectilinear in shape to provide a greater surface area for heat exchange with the liquid to be frozen. Alternatively, freezing members 110 may be cylindrical in shape or any other geometrical arrangement as long as the freezing members extend into the liquid to be frozen and provide adequate surface area for the exchange of heat between the liquid and the freezing members.

The freeze station 18 as shown in FIG. 3 preferably provides a controllable valve element 108 for each of the freezing members. By using a programmable logic control unit (not shown) such as that manufactured by Allen Bradley Co. of Waltham, Mass., each freezing member may be individually controlled for freezing and thawing the liquid. For example, the freeze members may be individually controlled to cause the liquid within the PCA to freeze from the center outwardly or vice versa. Alternatively, the controllable valve elements 108 for each of the freezing members 110 may be removed and a single line from the refrigerant supply conduit 102 to the inlet 116 of the freezing members may be used instead. In that case, valves controlling the flow of refrigerant or defrosting media into the refrigerant supply conduit 102 is provided by controllable valves mounted between the refrigerant or defrosting media supply and the refrigerant conduit 102. By controlling the rate of refrigerant flow through the valves to the refrigerant conduit 102, the conduit acts as a manifold that feeds the inlets 116 of all of the freezing members in freeze station 18. This type of arrangement may be used to simplify the control of the freezing and thawing of the liquid.

Figure 4:
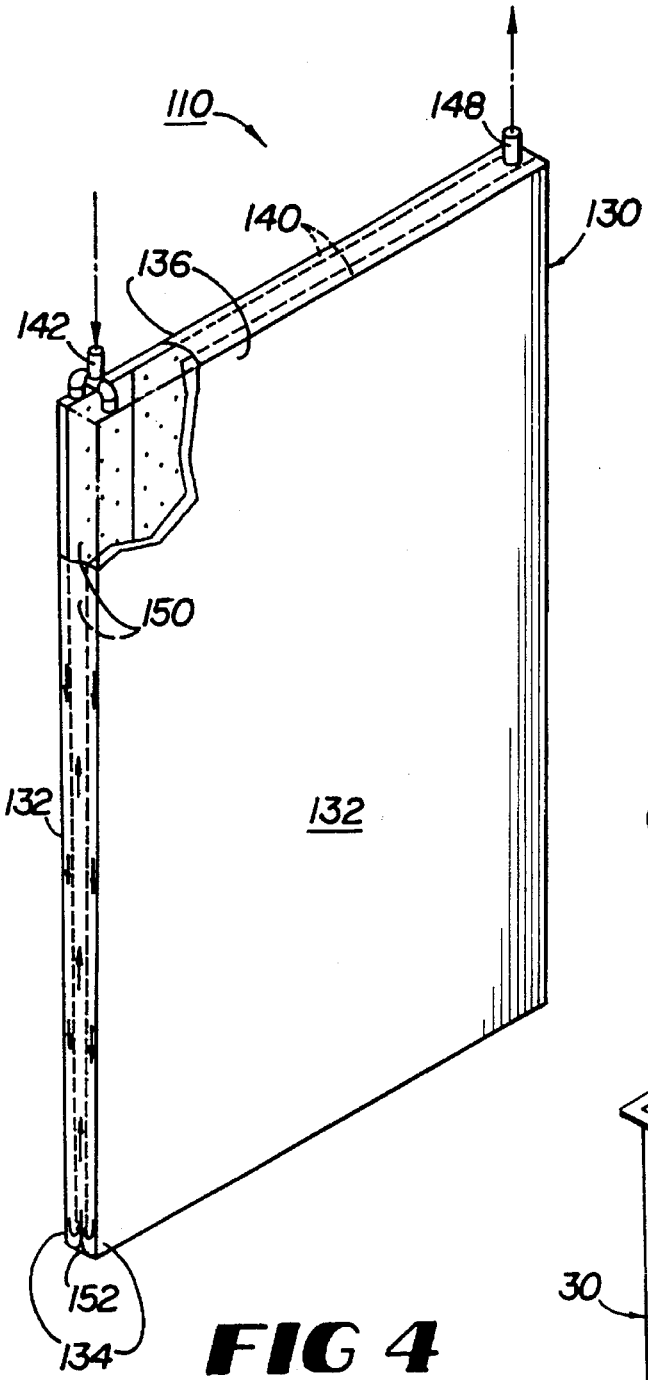
FIG. 4 is a perspective view of a preferred embodiment of a freezing member of a freeze station as shown in FIG. 3 with a cutaway to show the internal structure thereof.

A preferred embodiment of a freezing member 110 is shown in FIG. 4. The freezing member 110 is comprised of an external casing 130 that is preferably constructed of stainless steel or the like. Additionally, casing 130 is constructed so that opposed side walls 132 join at their bottom edges 134 and are separated at their upper edges 136 to form a V shaped casing. This V shape facilitates the removal of the freezing member from the frozen block. Mounted within casing 130 and located proximate to the opposed side walls 132 are carriers 140 for the flow of refrigerant or defrosting media. Carriers 140 are likewise arranged in a V shaped configuration. Preferably, at least two carriers are mounted within casing 130 so that the carriers are spaced apart, although one carrier within casing 130 may be used. Preferably, carriers 140 mounted within the casing 130 are freezer plates manufactured by Paul Mueller Co. of Springfield, Mo. and are designated by Mueller's registered trademark Temp-Plate. Alternatively, freezing member 110 may be constructed by welding a band about the top, bottom and sides of two freezer plates to enclose space 150. In that embodiment, the outside walls of the freezing member 110 are the outside walls of the freezer plates.

At the upper end of each carrier shown in FIG. 4, a common inlet conduit 142 extends upwardly into inlet 116. Each of the carriers 140 is open at its lower end 144 (FIG. 4*a*) and preferably, the lower ends 144 are separated from each other at a distance greater than that separating the upper ends of the carriers 140. A baffle 146 (FIG. 4*a*) is mounted at the lower end of the carriers 140 to provide a curved surface for each plate 140 which directs the flow of refrigerant exiting the carriers upwardly through the space separating the carriers 140. This space 150 is in fluid communication with outlet conduit 148 and in turn to outlet 118 which, as explained above, is coupled to suction conduit 104. Thus, refrigerant or defrosting media enter the common inlet 142, pass through the carriers 140, and exit to the lower ends 144 where they are directed by the baffle 146 into the space 150 between the carriers and outwardly through outlet conduit 148.

Figure 4A:
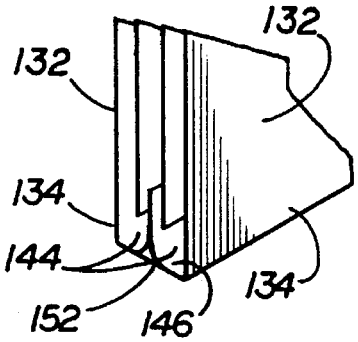
FIG. 4*a* is a detailed perspective of the baffle used in the preferred embodiment.

Baffle 146, FIG. 4*a*, not only facilitates the flow of refrigerant but assists in keeping the fluid flow path through the freezing member 110 clear. In refrigeration devices, the refrigerant is placed under pressure by a compressor to obtain the heat transfer characteristics of the refrigerant. Most refrigeration compressors entrain some oil used for lubrication of the compressor parts into the refrigerant flow. As the oil is cooled by the refrigerant it tends to settle and collect in low places through the refrigerant flow system. If a sufficient quantity of oil accumulates at a low point, it may block the flow of the refrigerant and substantially impair the cooling characteristics of the system. Baffle 146 provides a smooth surface by which the momentum of the falling oil through the cooler plates is directed in an upward fashion to facilitate its engagement with the suction and removal from the cooler plates. Without baffle 146, the oil tends to fall and strike the flat bottom wall 152 of casing 130 making it more difficult for the oil to be pulled out of the cooler plate.

Figure 5:
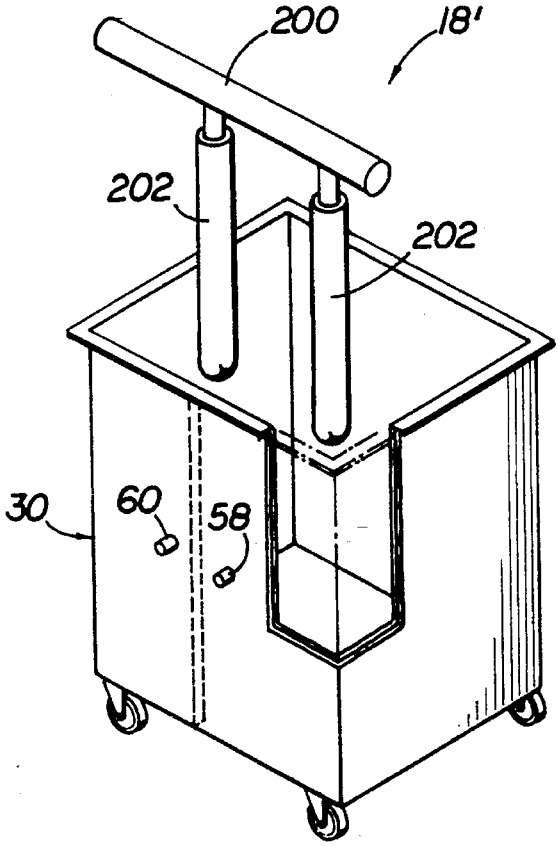
FIG. 5 is a perspective view of an alternative embodiment of a freeze station.

FIG. 5 shows an alternative embodiment of a freeze station 18'. That embodiment is shown to have a mounting bar 200 from which two support arms 202 downwardly extend. These support arms 202 may be cylindrical, rectilinear, or any other geometrical shape and may be either solid or hollow in construction. The members 202 may be supplied with a defrosting media, if hollow, for elevating the temperature of the support arms or may be supplied with electrical energy to heat the support arms through electrical resistance. Refrigerant is typically not supplied to the support arms of this alternative embodiment. Instead, the liquid within the PCA 30 is brought in proximity to the freeze station 18' shown in FIG. 5 and refrigerant is supplied to the inlet 58 of the PCA which is suctioned off through the outlet 60 of the PCA. As the refrigerant circulates through the vertical walls of the PCA, the liquid is cooled and eventually freezes. A valve may then be used to cause defrosting media to pass through the vertical walls of the PCA and melt the liquid proximate the walls so the PCA is released from the frozen block. With the freeze station 18' shown in FIG. 5, electrical energy or a defrosting media may then be supplied to the support arms 202 to release the frozen block once the lift has been raised to support the frozen block. Freeze station 18' is simpler in construction than freeze station 18 and does not require refrigerant controls for the support arm. However, the freeze times associated with this embodiment are longer than the embodiment shown in FIG. 3.

In use, the PCA 30 is positioned beneath the liquid supply line and the valve 42 opened to permit the flow of liquid into the PCA 30. When the liquid reaches the liquid level sensor, an observable predetermined height, or the weight of the PCA reaches a predetermined value, the valve 42 is closed so liquid no longer flows into the PCA. The inlet 58 of the PCA 30 is coupled to a refrigerant supply and the outlet 60 is coupled to a suction supply. PCA 30 is then moved from the fill station 12 to the weight bearing platform 34 of lift 16.

Lift 16 is operated to raise the PCA 30 so that freezing members 110 of freeze station 18 extend downwardly into the liquid within the PCA 30. When the PCA has been raised to a predetermined height, valves 108 are opened so that refrigerant flows from a pressurized source through refrigerant supply conduit 102 into the freezing plate members 110 and then outwardly through suction conduit 104. The flow of the refrigerant through the freezing members 110 provides a heat exchange mechanism for removing heat from the liquid within the PCA 30. The state of the liquid may be manually observed or monitored by sensors to determine when the liquid has frozen. Alternatively, a timer that approximates the time that the liquid should freeze may be used to generate a signal that closes the valves 108 so refrigerant no longer flows through freezing members 110. At that time, defrosting gas or liquid may then be supplied to the inlet 58 of PCA 30 so that the walls 52 of the PCA begin to warm to release the PCA from the exterior surface of the frozen block. The flow of the defrosting gas or liquid through the PCA 30 may be controlled by a timer, a sensor, or manually observed to detect when the PCA has released the frozen block. As the defrosting media thaws the frozen block adjacent the walls, the slope of the walls in the preferred embodiment of PCA 30 facilitates the sliding of PCA 30 away from the frozen block. Alternatively, lift 16 may be lowered a relatively short distance, for example, one or two inches, and the PCA 30 simply slides off the frozen block as it warms. Thereafter, the lift may be slowly lowered to support the PCA as it slides off the frozen block. Once the lift has fully lowered the weight bearing platform 34 so the PCA 30 is clear of the frozen block, the PCA may be returned to the fill station 12 for filling.

A pallet 64 is supplied from pallet supply 14 and moved about conveyor 24 to a position proximate the weight bearing surface 34 of lift 16. After PCA 30 has been removed from the weight bearing surface 34 of lift 16, pallet 62 is positioned underneath the frozen block. Rectangular frame 86 of bagger 20 is mounted with a polymeric bag and swiveled between the pallet on the weight bearing surface of lift 16 and the bottom surface of the frozen block. The retractable arm 84 is then raised upwardly until the bag extends about the bottom and vertical sides of the frozen block.

The weight bearing surface 34 of lift 16 with pallet 64 positioned thereon is raised to be proximate the bottom surface of the frozen block. Defrosting media is now supplied to refrigerant conduit 102 so that the defrosting media flows through the refrigerant supply conduit 102, freezing members 110 and suction conduit 104 to warm the freezing members. As the freezing members are warmed, the frozen liquid proximate the freezing members thaws and the frozen block slides from the freezing members. As the frozen block comes to rest on the pallet 64 on the weight bearing surface 34 of the lift 16, the lift is slowly lowered. After the block has fully descended from the freeze station 18, rectangular frame 86 is raised above the upper edge of the frozen block and the bag released from the frame, so the frame may be swiveled away from the frozen block and out of the path of the freeze station. The frozen block within the polymeric bag is then moved off of the weight bearing surface of lift 16 to conveyor 24. Sealer 22 then automatically folds the open end of the bag and seals it to protect the frozen liquid. Preferably, sealer 22 is a banding machine which encircles the frozen block with metal strips or the like, although other methods of sealing the bag may be used such as heat sealing. The bag may now be moved to the unloading area for transportation to a warehouse. Additionally, a second product supply conduit may be provided at conveyor 24 prior to sealer 22 to fill the openings in the frozen block left by freezing members 110. The block is sufficiently cold enough to freeze this additional product.

In the alternative embodiment, the PCA is filled and positioned beneath the freeze station as described above. Thereafter, a refrigerant is supplied to the inlet of the PCA to cool the walls of the container and freeze the liquid therein. After the liquid has frozen, defrosting media is supplied to the PCA so the walls warm and the PCA is released from the frozen block. After the PCA is returned to the filling station and a pallet is provided beneath the frozen block, defrosting media or electrical energy is supplied to the support arms to thaw and release the frozen block from the freeze station. Once the frozen block is released from the freeze station, the process implemented by the alternative embodiment of the inventive system is performed.

In another alternative process, PCA 30 may be used without freeze station 18. In this process, PCA 30 is supplied with refrigerant through inlet 58 to cool the walls 52 of PCA 30 and freeze the liquid. Thereafter, PCA 30 is supplied with a sufficient amount of defrosting media to thaw the frozen block adjacent walls 52 of PCA 30. PCA 30 is then rotated with known devices, such as a forklift, for example, to permit the block to slide out of PCA 30 and onto conveyor 24.

While the present invention has been illustrated by the description of a preferred and alternative embodiments and processes, and while the preferred and alternative embodiments and processes have been described in considerable detail, it is not the intention of the applicant to restrict or in any way limit the scope of the appended claims to such detail. Additional advantages and modifications will readily appear to those skilled in the art. For example, rather than using conventional refrigerants to cool the freezing members, cryogenic liquids may be supplied to more quickly freeze the liquid within the PCA. The invention in its broadest aspects is therefore not limited to the specific details, preferred embodiment, and illustrative examples shown and described. Accordingly, departures may be made from such details without departing from the spirit or scope of applicant's general inventive concept.

What is claimed is:

1. A method for freezing a large block of liquid comprising:

lifting a vessel to a freeze station;

freezing a liquid in said vessel into a block at said freeze station;

separating said vessel from said frozen block of liquid by supplying defrosting media through hollow walls of said vessel to thaw said frozen liquid proximate said walls of said vessel; and releasing said frozen block from said freeze station.

2. The method of claim 1, said freezing step further comprising the steps of:

extending at least one freezing member into said liquid within said vessel prior to freezing said liquid into a block.

3. The method of claim 2, said freezing step further comprising:

supplying a refrigerant through said freezing member to transfer heat from said liquid to said refrigerant.

4. The method of claim 1, said freezing step further comprising:

supplying a refrigerant through hollow walls of said vessel to transfer heat from said liquid to said refrigerant.

5. The method of claim 2, said releasing step further comprising:

supplying defrosting media through said freezing member to thaw said frozen liquid proximate said freezing member.

6. The method of claim 2, further comprising:

extending a support arm into said liquid within said vessel prior to freezing said liquid into a block; and electrically heating said support arm to thaw said frozen liquid proximate said support arm.

7. The method of claim 1 furthering comprising:

filling said vessel with said liquid to be frozen;

moving said vessel to a lift for said lifting step;

lowering said vessel after said vessel is separated from said liquid frozen into a block; and returning said vessel to a position for said filling step.

8. A method for freezing a large block of liquid comprising:

lifting a vessel containing a liquid to a freeze station;

freezing said liquid into a block at said freeze station;

separating said vessel from said frozen block of liquid;

releasing said frozen block from said freeze station;

bagging said frozen block of liquid prior to said releasing step; and sealing said frozen block of liquid after said releasing step.

9. A method for freezing a large amount of a liquid or slurry comprising:

filling a product containment apparatus with one of a liquid and a slurry to be frozen;

supplying a refrigerant through an outlet in said product containment apparatus whereby heat is transferred from said liquid to said refrigerant and said liquid freezes;

supplying a defrosting media to an inlet in said product containment apparatus;

suctioning said refrigerant through an outlet in said product containment apparatus whereby heat is transferred from said liquid to said refrigerant and said liquid freezes;

supplying a defrosting media to an inlet in said product containment apparatus;

suctioning said defrosting media through an outlet in said product containment apparatus whereby heat is transferred to said liquid from said defrosting media and said frozen liquid adjacent said product containment apparatus thaws; and rotating said product containment apparatus to remove said frozen block.

* * * * *